US010653580B2

(12) United States Patent
Matsushita

(10) Patent No.: US 10,653,580 B2
(45) Date of Patent: May 19, 2020

(54) BEAUTY DEVICE

(71) Applicant: MTG CO., LTD., Nagoya-shi, Aichi (JP)

(72) Inventor: Tsuyoshi Matsushita, Nagoya (JP)

(73) Assignee: MTG CO., LTD., Nagoya-shi, Aichi (JP)

( * ) Notice: Subject to any disclaimer, the term of this patent is extended or adjusted under 35 U.S.C. 154(b) by 286 days.

(21) Appl. No.: 15/711,199

(22) Filed: Sep. 21, 2017

(65) Prior Publication Data

US 2018/0140499 A1 May 24, 2018

(30) Foreign Application Priority Data

Nov. 21, 2016 (JP) ..... 2016-226374

(51) Int. Cl.
*A61H 15/00* (2006.01)
*A61H 7/00* (2006.01)
*A61H 23/02* (2006.01)

(52) U.S. Cl.
CPC ..... *A61H 15/0085* (2013.01); *A61H 7/005* (2013.01); *A61H 7/007* (2013.01);
(Continued)

(58) Field of Classification Search
CPC .... A61H 15/0085; A61H 7/001; A61H 7/005; A61H 7/007; A61H 2205/022;
(Continued)

(56) References Cited

U.S. PATENT DOCUMENTS 9,987,109 B2 * 6/2018 Sokol ..... A61C 17/36
2013/0245509 A1 * 9/2013 Tanigawa ..... A61H 15/0092 601/20

(Continued)

FOREIGN PATENT DOCUMENTS

JP 2013-103085 A 5/2013
JP 2015-180393 10/2015

(Continued)

OTHER PUBLICATIONS

Machine generated translation of JP 2013-103085 (Year: 2013).*
European Search Report dated Mar. 23, 2018 for European Patent Application No. 7001 559.8. (8 pages).

*Primary Examiner* — Tu A Vo
*Assistant Examiner* — Kelsey E Baller
(74) *Attorney, Agent, or Firm* — Smith, Gambrell & Russell, LLP

(57) ABSTRACT

A beauty device includes a handle, an inner lid, a pair of support shafts, a pair of rotation bodies, a water stop portion, and an outer lid. The handle is formed with a housing portion. The inner lid is mounted to the handle to seal the housing portion. The pair of support shafts is extended from one end of the handle. The pair of rotation bodies is rotatably supported around the support shafts. The water stop portion is intervened between the housing portion and the inner lid to contact with a peripheral edge of an opening of the housing portion. The outer lid closes the opening while covering the inner lid such that the outer lid is fitted in the housing portion in a state where a part of an outer circumference surface of the outer lid facing an inner circumference surface of the opening is visible from an outside.

10 Claims, 10 Drawing Sheets

(52) U.S. Cl.
CPC ..... *A61H 23/02* (2013.01); *A61H 2015/0007* (2013.01); *A61H 2015/0042* (2013.01); *A61H 2201/0111* (2013.01); *A61H 2201/0157* (2013.01); *A61H 2201/1215* (2013.01); *A61H 2201/1671* (2013.01); *A61H 2201/1678* (2013.01); *A61H 2205/022* (2013.01)

(58) Field of Classification Search
CPC .... A61H 2201/1671; A61H 2201/1215; A61H 2201/0157; A61H 2201/0111; A61H 2201/1678; A61H 2015/0007; A61H 2015/0042; A61H 23/02; A61H 39/00; A61H 39/04; A45D 34/04; A45D 34/041; A45D 40/261; A45D 40/26; A45D 2200/1009; A45D 2200/1018
USPC ..... 132/317, 320
See application file for complete search history.

(56) References Cited

U.S. PATENT DOCUMENTS

| | | | |
|---|---|---|---|
| 2014/0135798 | A1 | 5/2014 | David |
| 2018/0140500 | A1 | 5/2018 | Matsushita |

FOREIGN PATENT DOCUMENTS

| | | | |
|---|---|---|---|
| JP | 2015-186540 | A | 10/2015 |
| WO | 2012/053547 | | 4/2012 |

* cited by examiner

BEAUTY DEVICE

CROSS-REFERENCE TO RELATED APPLICATIONS

This application is based upon and claims the benefit of priority from the prior Japanese Patent Application No. 2016-226374 filed on Nov. 21, 2016, the entire contents of which are incorporated herein by reference.

BACKGROUND

1. Technical Field

The present invention relates to a beauty device.

2. Related Art

JP 2015-186540 A discloses a conventional beauty device. The beauty device is provided with a handle and a pair of rotation bodies. A pair of the rotation bodies is rotatably supported around a pair of shafts arranged at one end portion of the handle so as to spread toward distal ends thereof. The handle includes a handle body and a handle cover. A recess portion is formed on the handle body, and the handle cover closes the recess portion. An engaging claw is formed on the handle cover. The handle cover is fixed to the handle body to close the recess portion by engaging the engaging claw with an engaged portion formed in the recess portion. Further, the handle cover is fixed to the handle body via an O-ring to seal the recess portion in a fluid-tight manner. The O-ring is intervened between an outer circumference surface of the handle cover and an inner circumference surface of the recess portion.

The beauty device can apply a beauty effect such as a massaging effect to skin by pressing and rolling the rotation body against the skin. Further, in order to improve such a beauty effect, it is demanded that the beauty device can be used in bathing, and therefore waterproof performance is necessary for the beauty device.

SUMMARY

The beauty device disclosed in JP 2015-186540 A is used while the handle is being held in use. That is, a user of the beauty device grasps the handle body and the handle cover to use the beauty device. At this time, different forces in different directions might be applied to the handle body and the handle cover, which are separately arranged, respectively. In this case, unbalanced load is applied to the O-ring intervened between the handle body and the handle cover, and therefore the waterproof performance might be deteriorated.

The present invention is derived from the problem of the conventional beauty device described above, and an object of the present invention is, in order to solve the problems described above, to provide a beauty device capable of successfully ensuring waterproof performance.

The beauty device according to the present invention includes:

a handle formed with a housing portion in a recessed shape;

an inner lid mounted to the handle to seal the housing portion;

a pair of support shafts extended from an end portion at one side of the handle;

a pair of rotation bodies rotatably supported around the support shafts;

a water stop portion intervened between the housing portion and the inner lid to contact with a peripheral edge of an opening of the housing portion in a fluid-tight manner; and an outer lid which closes the opening of the housing portion while covering the inner lid such that the outer lid is fitted in the housing portion in a state where an outer circumference surface of the outer lid is arranged to face an inner circumference surface of the opening of the housing portion and a part of the outer circumference surface facing the inner circumference surface is visible from an outside.

The beauty device includes the inner lid other than the outer lid which closes the opening of the housing portion. Further, the water stop portion which contacts with the peripheral edge of the opening of the housing portion in a fluid-tight manner is intervened between the housing portion and the inner lid. According to such a configuration, a holding force when the handle is held is suppressed to be applied to the inner lid directly, and thereby an influence to the water stopping performance of the water stop portion can be suppressed.

Accordingly, the beauty device of the present invention can successfully ensure waterproof performance.

DETAILED DESCRIPTION

Figure 1:
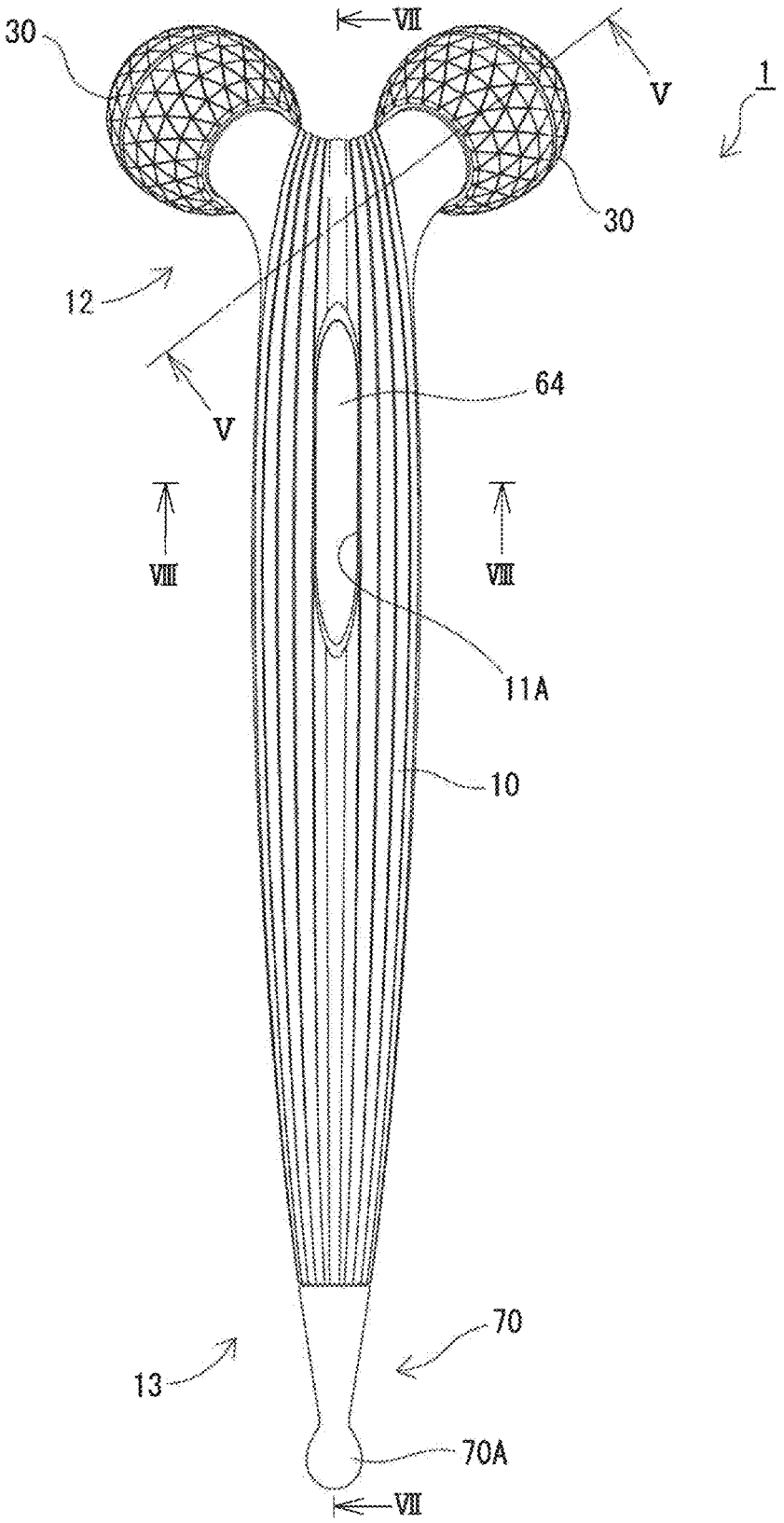
FIG. 1 is a front view illustrating a beauty device according to a first example.

Hereinafter, preferred embodiments according to the present invention are described.

In a beauty device according to the present invention, the water stop portion may be arranged on an outer edge of the inner lid. In this case, since the water stop portion is arranged on the outer peripheral edge of the inner lid in advance, assembling operation can be simplified.

The beauty device according to the present invention may include a housed member which is assembled to the inner lid and housed in the housing portion. In this case, since the housed member is housed in the housing portion, the waterproof performance of the housed member can be ensured. Further, since the housed member can be housed in the housing portion by mounting the inner lid, the assembling operation can be simplified.

In the beauty device according to the present invention, the housed member may be a power source portion which generates current, and the handle and each of the rotation bodies may have conductivity and may be electrically connected to the power source portion. In this case, when the rotation body is rolled on skin of a face or the like while a user is holding the handle of the beauty device, an electric circuit is formed between the handle and the rotation body via a body of the user, and stimulation to the skin is promoted by weak current provided from the rotation body. Further, the power source portion which generates the current is housed in the housing portion, and thereby the waterproof performance of the power source portion is ensured. Thus, the weak current is preferably provided.

The beauty device according to the present invention may include a beauty effect applying portion, which applies a beauty effect to skin by being contacted with or close to the skin, arranged at another end portion of the handle. Further, the beauty effect applying portion may include a fixed shaft inserted into the handle from the other end portion of the handle toward the housing portion and fixed when the inner lid is mounted to the handle. In this case, the beauty effect can be applied by using the other end portion in addition to using the rotation body at a side of one end portion of the handle. Thus, the beauty device capable of applying the beauty effect in various aspects in addition to the applying of the beauty effect by means of the rotation body can be obtained.

Next, a first example embodying the beauty device according to the present invention is described with reference to drawings.

FIRST EXAMPLE

As shown in FIG. 1 through FIG. 5, a beauty device 1 according to the first example is provided with a handle 10, a support shaft 20, a rotation body 30, an inner lid 40, a water stop portion 41, and an outer lid 50. The handle 10 is provided with a housing portion 11. A pair of the support shafts 20 is arranged, and the support shafts 20 are arranged at a side of one end portion 12 of the handle 10 to spread toward distal ends thereof. A pair of the rotation bodies 30 is arranged. Each of the rotation bodies 30 is rotatably supported around the support shaft 20. The inner lid 40 is mounted to the handle 10 to seal the housing portion 11. The water stop portion 41 is arranged between the housing portion 11 and the inner lid 40 to contact with a peripheral edge of an opening of the housing portion 11 in a fluid-tight manner. The outer lid 50 closes the opening of the housing portion 11. Further, the beauty device 1 is provided with a solar power generation panel (as an example of a housed member and a power source portion according to the present invention) 60 and a beauty effect applying portion 70.

Figure 4:
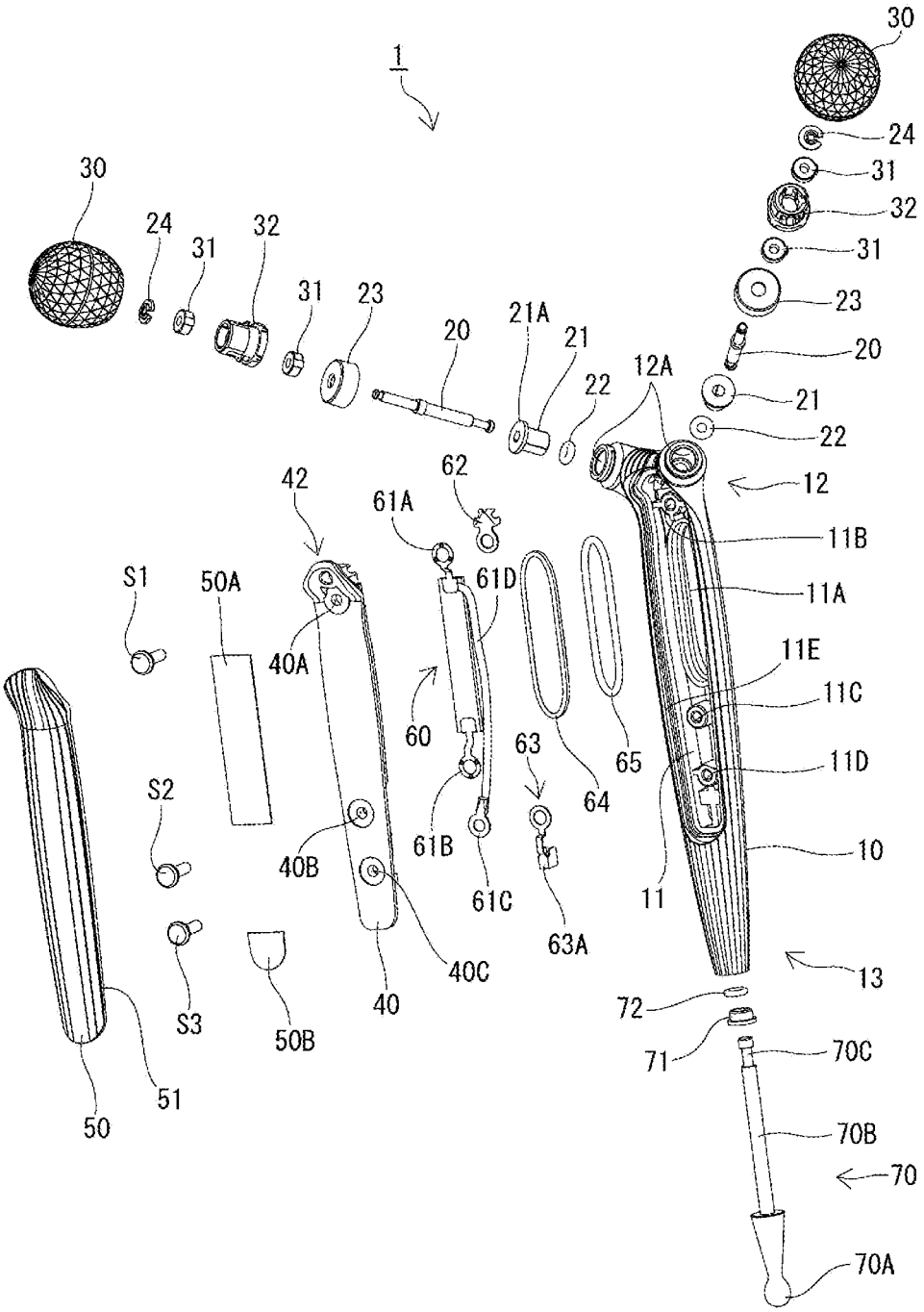
FIG. 4 is an exploded perspective view illustrating the beauty device according to the first example.

As shown in FIG. 1 through FIG. 4, the handle 10 is formed in an elongate shape in which the side of the end portion 12 as one end side in a longitudinal direction is branched so as to spread toward a distal end of the handle 10 and a side of an end portion 13 as another end side is tapered toward a distal end of the handle 10. The handle 10 is formed of ABS resin on which chrome plating is applied, and therefore the handle 10 has conductivity. Further, a plurality of stripes along the longitudinal direction like a ridge which rises and falls in a circumferential direction is formed on an outer surface of the handle 10. As shown in FIG. 4, the housing portion 11 is formed at a rear surface side of the handle 10 in a recessed shape in a section so as to be recessed along the longitudinal direction. Further, a penetration hole 11A, which penetrates the handle 10 to be communicated with the housing portion 11, is formed at a front surface side of the handle 10. The penetration hole 11A is formed on the front surface of handle 10 at a side close to the end portion 12. Further, bosses 11B, 11C, 11D are formed on an inner wall of the housing portion 11. The bosses 11B, 11C, 11D are used for mounting the inner lid 40 as described below. Further, chrome plating which continues to the chrome plating on the outer surface of the handle 10 is applied to the boss 11C, while the chrome plating is not applied to the bosses 11B, 11D and therefore the ABS resin of the bosses 11B, 11D is exposed.

Figure 5:
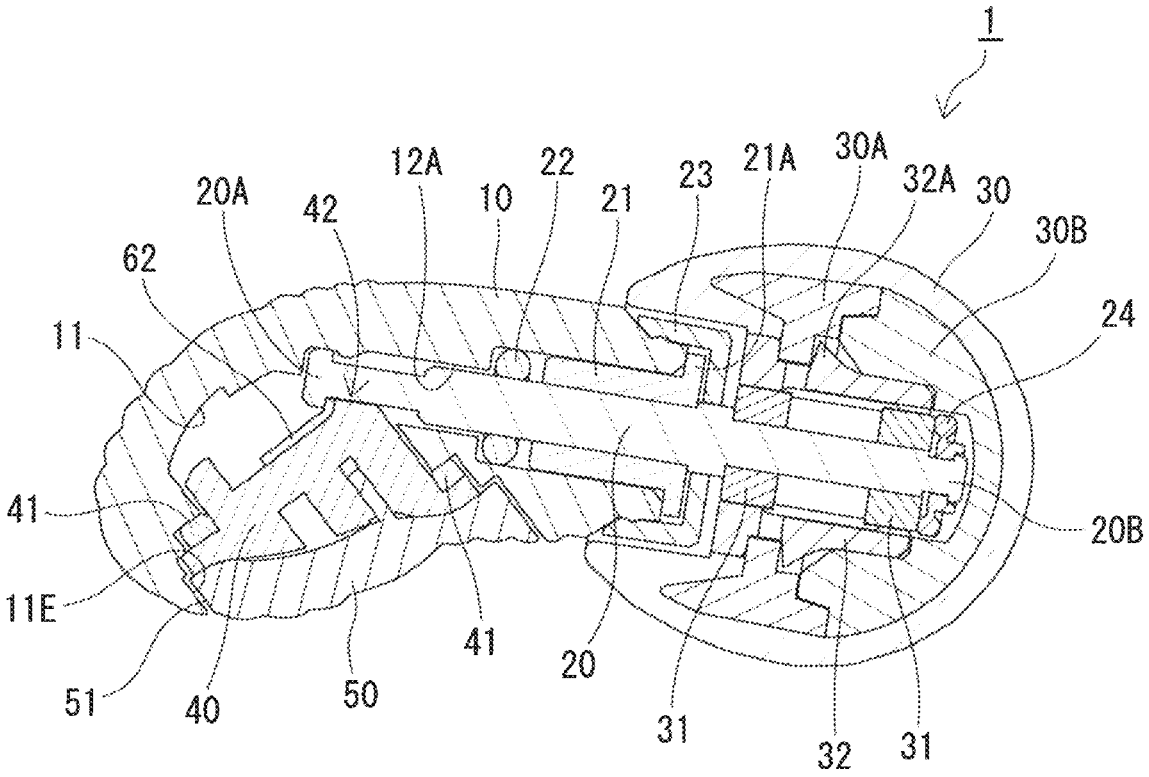
FIG. 5 is a cross-sectional view taken along line V-V in FIG. 1.
Figure 7:
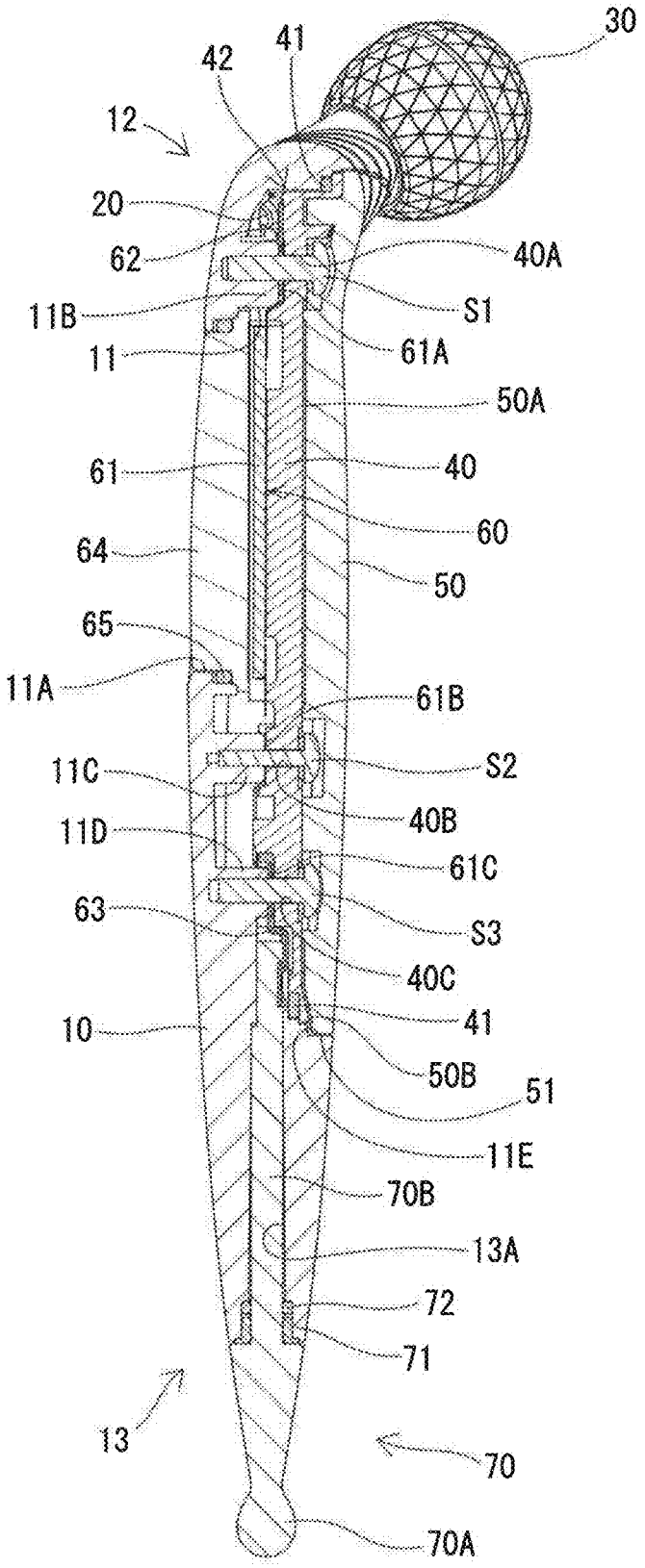
FIG. 7 is a cross-sectional view taken along line VII-VII in FIG. 1.

As shown in FIG. 4 and FIG. 5, a shaft hole 12A is formed on the end portion 12 of the handle 10. The shaft hole 12A is formed on each of distal end portions of bifurcated branch of the end portion 12 of the handle 10. The shaft hole 12A is formed to penetrate the inner wall of the housing portion 11. That is, the shaft hole 12A and the housing portion 11 are formed to be communicated with each other. Further, as shown in FIG. 7, a shaft hole 13A is formed on the end portion 13 of the handle 10. The shaft hole 13A is formed on a distal end of the end portion 13. The shaft hole 13A is formed, similar to the shaft hole 12A, to penetrate the inner wall of the housing portion 11 to be communicated with the hosing portion 11.

Figure 2:
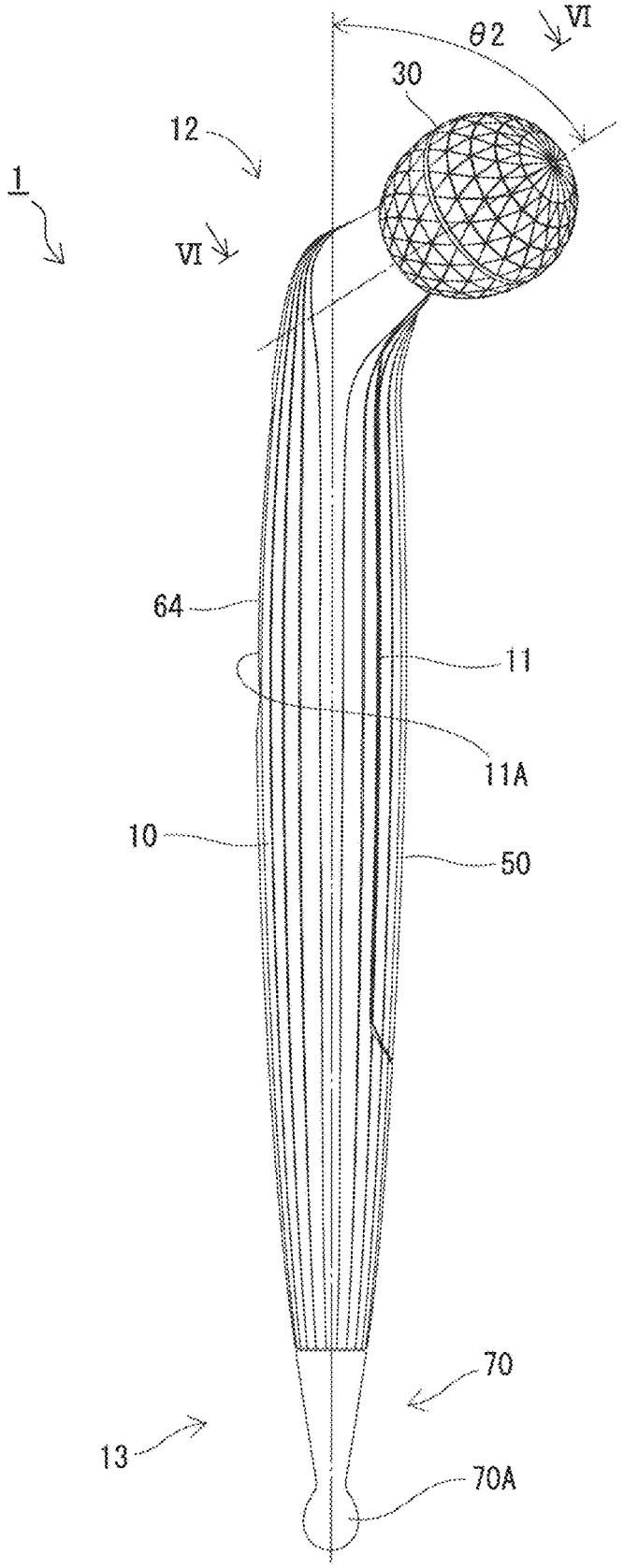
FIG. 2 is a side view illustrating the beauty device according to the first example.
Figure 3:
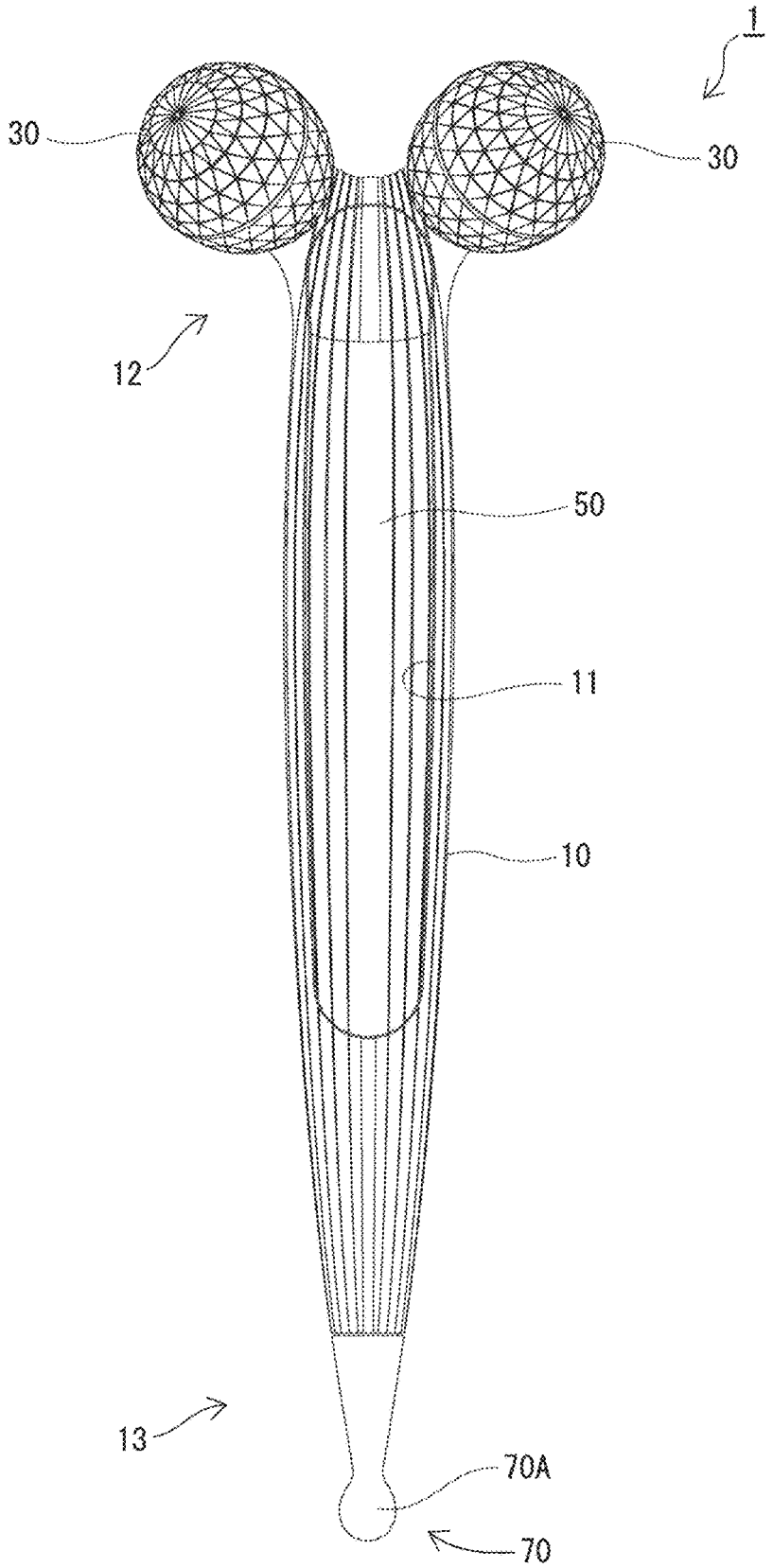
FIG. 3 is a rear view illustrating the beauty device according to the first example.
Figure 6:
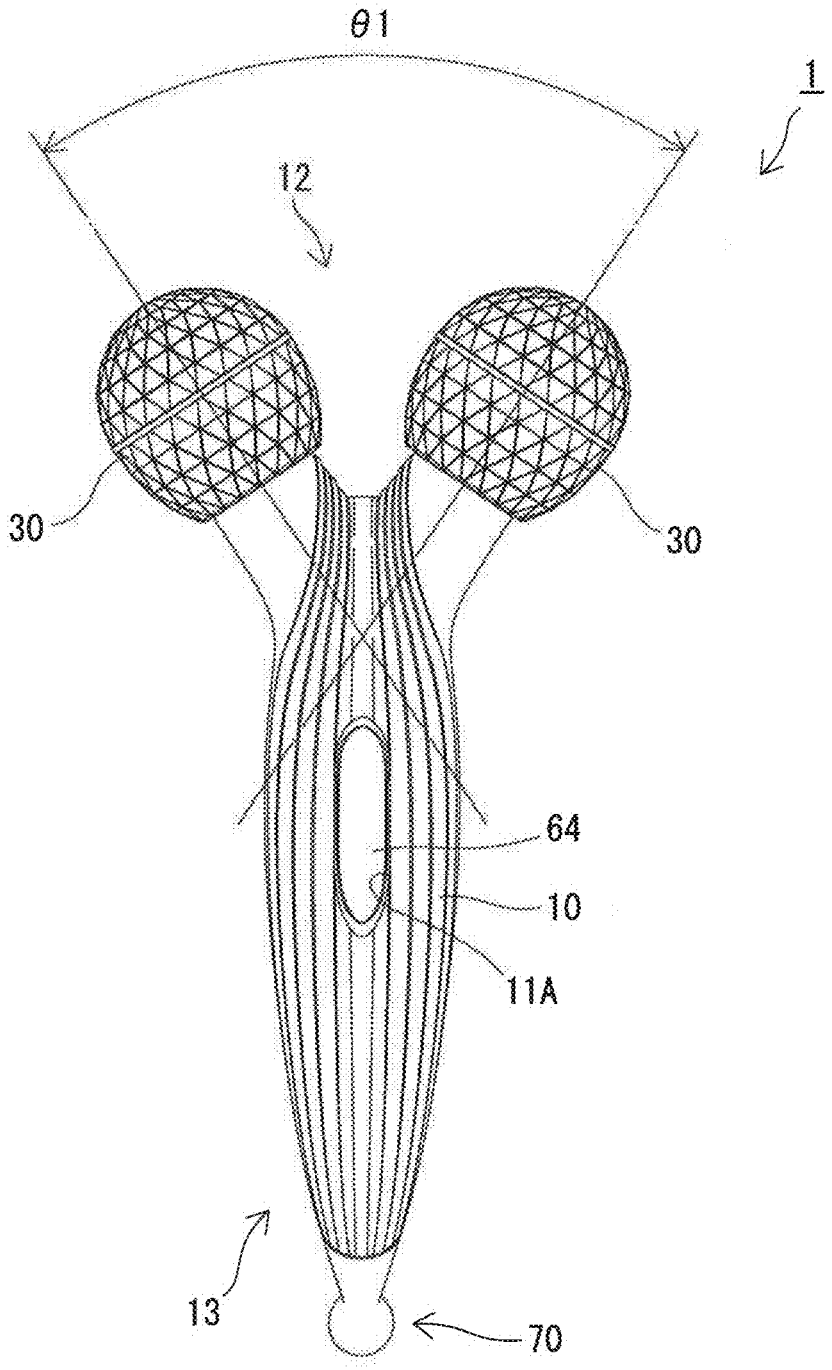
FIG. 6 is a view seen along line VI-VI in FIG. 2.

As shown in FIG. 4 and FIG. 5, the support shafts 20, which form a pair, are each inserted into the shaft hole 12A of the handle 10 through an insulation bush 21, an O-ring 22 and a cap 23. The support shaft 20 is formed of stainless steel to which electroless nickel plating is applied. As shown in FIG. 6, the support shafts 20, which form a pair, are inserted into the shaft holes 12A of the handle 10 respectively, and thereby the support shafts 20 are extended to spread with an angle θ1 between mutual axial lines of the support shafts 20. In the present example, the angle θ1 is set to approximately 66.7 degrees. Further, as shown in FIG. 2, the pair of the support shafts 20 is inclined toward the rear surface side of the handle 10 with an angle θ2 against a center line of the handle 10 when seen from a side. In the present example, the angle θ2 is set to approximately 60 degrees.

The insulation bush 21 is formed of polyacetal. The insulation bush 21 is provided with a flange portion 21A expanded in a diameter of the insulation bush 21 in a flange shape at one end of the insulation bush 21. The insulation bush 21 insulates the support shaft 20 from the handle 10. The support shaft 20 is inserted into the insulation bush 21. The insulation bush 21 closes the shaft hole 12A by the flange portion 21A contacting with a peripheral edge of the shaft hole 12A. The O-ring 22 is intervened between the outer circumference surface of the support shaft 20 and the inner circumference surface of the shaft hole 12A in a fluid-tight manner. Each of the caps 23, into which the support shaft 20 is inserted, is fitted to the distal end of each of the end portions 12 of the handle 10. Further, as shown in FIG. 5, one end portion 20A of the support shaft 20 is locked with a shaft locking portion 42 of the inner lid 40 described below. With this, the support shaft 20 is locked without dropping off from the shaft hole 12A. Further, another end portion 20B of the support shaft 20 is attached with a preloading C-ring 24 which prevents a resin bearing 31 and a bearing holder 32 described below from dropping off and applies preload to the resin bearing 31.

As shown in FIG. 4 and FIG. 5, the rotation body 30 is mounted to the support shaft 20 at a side of another end portion 20B. The rotation body 30 is formed of ABS resin on which platinum plating is applied. The rotation body 30 is formed of two core members 30A, 30B formed by means of insert molding. Outer shape of the rotation body 30 is formed in a substantially spherical shape. Further, so-called diamond cut is applied to a surface of the rotation body 30. The support shaft 20 is inserted into each of the rotation bodies 30 via two resin bearings 31 and the bearing holder 32 which holds the two resin bearings 31. With this, the rotation body 30 is rotatably supported by the support shaft 20 around a center axis of the support shaft 20. Further, the resin bearing 31 is formed of polyacetal having conductivity. The bearing holder 32 is formed of ABS resin on which chrome plating is applied. With this, the rotation body 30 is electrically connected to the support shaft 20 via the resin bearing 31 and the bearing holder 32. Further, an engaging claw 32A which elastically deforms in a radial direction is formed on the bearing holder 32. The engaging claw 32A is engaged with a recess formed in a stepped shape on an inner circumference of the rotation body 30 so as to fix the rotation body 30.

The inner lid 40 is formed of ABS resin and formed in a substantially flat plate shape. As shown in FIG. 4, FIG. 5, and FIG. 7, the inner lid 40 is provided with a water stop portion 41 and the shaft locking portion 42. That is, in the present example, the water stop portion 41 is integrally formed with the inner lid 40. The water stop portion 41 is formed on an outer edge of one surface of the inner lid 40. The water stop portion 41 is formed of thermoplastic elastomer formed integrally with the inner lid 40. The support shaft 20 is locked with the shaft locking portion 42. Further, as shown in FIG. 4 and FIG. 7, three screw holes 40A, 40B, 40C are formed on the inner lid 40. Screws S1, S2, S3 inserted into the screw holes 40A, 40B, 40C are locked with the bosses 11B, 11C, 11D of the housing portion 11 respectively, and thereby the inner lid 40 is mounted to the handle 10. Further, the inner lid 40 is mounted to the handle 10 in a fastening direction of the screws S1, S2, S3 as a mounting direction. In the present example, the inner lid 40 is mounted in a direction from a right side toward a left side in FIG. 7 (from a lower side toward an upper side in FIG. 8). Further, the water stop portion 41 contacts with the peripheral edge of the opening of the housing portion 11 while being pressed against the inner lid 40. That is, the water stop portion 41 is pressed against the peripheral edge of the opening of the housing portion 11 by means of pressing force due to the fastening of the screws S1, S2, S3 in a pressing direction defined by the mounting direction of the inner lid 40 to the handle 10.

Figure 8:
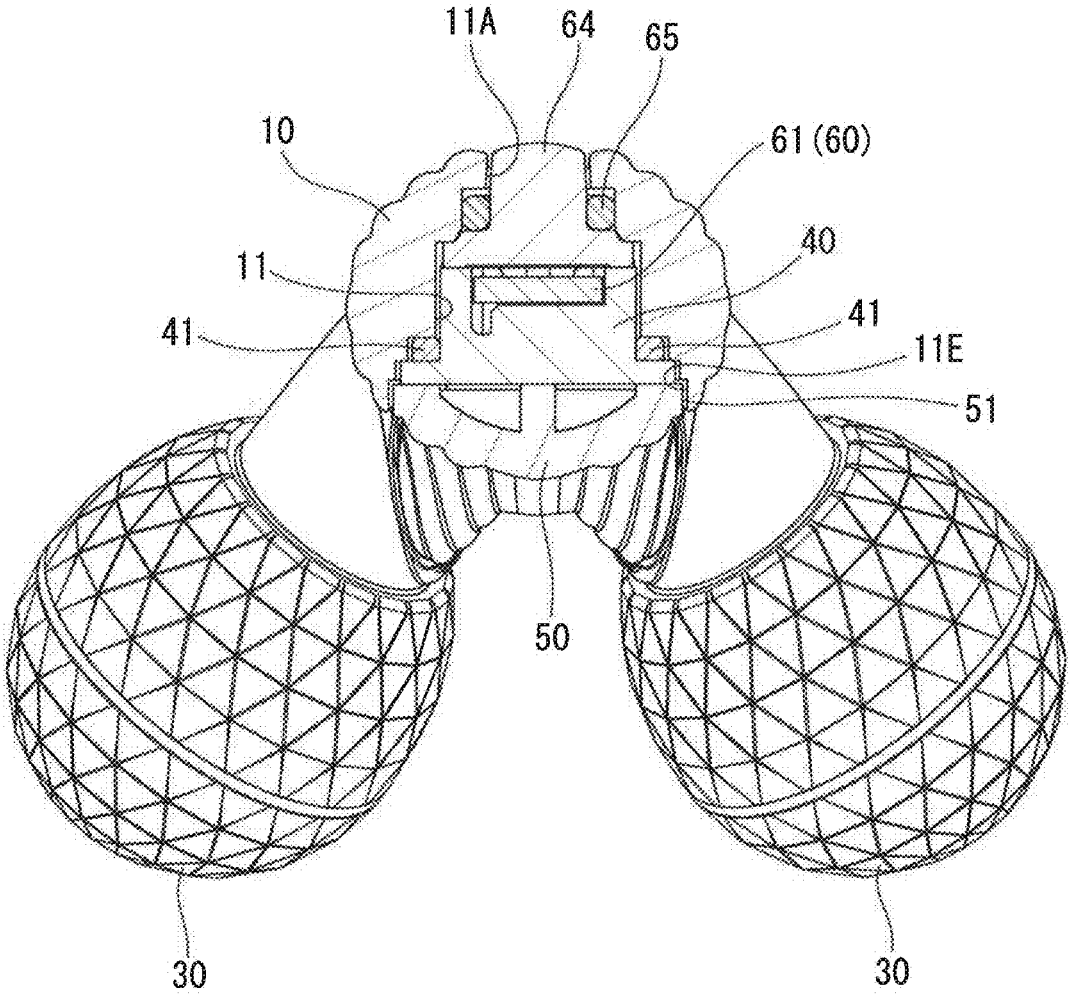
FIG. 8 is a cross-sectional view taken along line VIII-VIII in FIG. 1.

The outer lid 50 is formed of ABS resin on which chrome plating is applied. In the present example, the outer lid 50 is adhered with the inner lid 40 by double sided tapes 50A, 50B. With this, the outer lid 50 is fitted to the housing portion 11 to cover the inner lid 40 and close the opening of the housing portion 11. As shown in FIG. 7 and FIG. 8, the outer lid 50 is fitted in the housing portion 11. The outer lid 50 is fitted such that an outer circumference surface 51 faces an inner circumference surface 11E (a surface extended in a depth direction of the housing portion 11) of the opening of the housing portion 11. A part where the outer circumference surface 51 of the outer lid 50 and the inner circumference surface 11E of the opening of the housing portion 11 face each other is visible from an outside. When the handle 10 is held and force is applied to the outer lid 50 in a direction crossing a fitting direction of the outer lid 50, displacement of the outer lid 50 is suppressed while the outer lid 50 is interfering with the inner circumference surface 11E of the opening of the housing portion 11. Further, it is difficult to apply force in a removing direction (a direction opposite to the fitting direction) to the outer lid 50 fitted in the housing portion 11, and therefore the outer lid 50 is hardly removed. Further, similar to the handle 10, the outer lid 50 has stripes like a ridge on the outer circumference surface, and when the outer lid 50 closes the opening of the housing portion 11, the outer lid 50 is formed into a continuous shape with the handle 10. Further, the stripes like a ridge are formed along the longitudinal direction of the outer lid 50 and the handle 10, and thereby a boundary between the outer lid 50 and the handle 10 in which the stripes are extended in the similar direction is inconspicuous.

The solar power generation panel 60 is mounted to the inner lid 40 and housed in the housing portion 11. The solar power generation panel 60 is formed in a substantially rectangular thin plate shape. In the solar power generation panel 60, a ring-like terminal 61A is connected to one electrode and a ring-like terminal 61B is connected to another electrode. The solar power generation panel 60 generates electric power by receiving light transmitted through a lens 64 described below and supplies the weak current between a surface of the rotation body 30 and a surface of the handle 10 via the ring-like terminals 61A, 61B. The ring-like terminals 61A, 61B are arranged to be overlapped with the screw holes 40A, 40B of the inner lid 40 respectively when the solar power generation panel 60 is mounted to the inner lid 40. The ring-like terminals 61A, 61B are intervened between the inner lid 40 and the bosses 11B, 11C and fastened and fixed by the screws S1, S2 respectively. Further, a shaft holder 62 described below is also fastened and fixed between the inner lid 40 and the boss 11B.

Further, a ring-like terminal 61C is connected to the one electrode of the solar power generation panel 60 in a parallel manner with the ring-like terminal 61A. The solar power generation panel 60 also supplies the weak current between the beauty effect applying portion 70 described below and the surface of the handle 10 via the ring-like terminals 61B, 61C. The ring-like terminal 61C is connected to the solar power generation panel 60 via a lead wire 61D. The ring-like terminal 61C is intervened between the inner lid 40 and the boss 11C and fastened and fixed by the screw S3. Further, a shaft holder 63 described below is also fastened and fixed between the inner lid 40 and the boss 11D.

The shaft holder 62 is disposed on the shaft locking portion 42 of the inner lid 40. The shaft holder 62 is formed of stainless steel and contacted with both of the support shafts 20, which form a pair, and thereby the shaft holder 62 is electrically connected to the support shafts 20. The shaft holder 62 is fastened together with the ring-like terminal 61A between the inner lid 40 and the boss 11B by fastening of the screw S1. That is, the shaft holder 62 is fixed to be electrically connected to the ring-like terminal 61A. With this, one electrode of the solar power generation panel 60 is electrically connected to the support shafts 20 via the ring-like terminal 61A and shaft holder 62, and further electrically connected to the rotation bodies 30 via the support shafts 20. The screw S2 fastened to the boss 11C is inserted into the ring-like terminal 61B and the inner lid 40, and thereby the ring-like terminal 61B is fixed together with the inner lid 40. Further, as described above, the chrome plating continued to the chrome plating of the outer surface of the handle 10 is formed on the boss 11C, and thereby the other electrode of the solar power generation panel 60 and the handle 10 are electrically connected.

The shaft holder 63 is formed, similar to the shaft holder 62, of stainless steel. The shaft holder 63 is fastened together with the ring-like terminal 61C between the inner lid 40 and the boss 11D by the fastening of the screw S3. With this, the shaft holder 63 is fixed to be electrically connected to the ring-like terminal 61C. Further, the shaft holder 63 is provided with a shaft locking portion 63A formed in a substantially U-shape in a section. The shaft locking portion 63A is locked with a small diameter portion 70C of the beauty effect applying portion 70 described below.

The lens 64 is formed of transparent acryl resin. As shown in FIG. 7 and FIG. 8, the lens 64 is formed in a convex shape in a section and inserted into the penetration hole 11A. The lens 64 is pressed by the inner lid 40 and contacted with a peripheral edge portion of the penetration hole 11A, and thereby the lens 64 is fixed. The lens 64 is arranged adjacent to the solar power generation panel 60. An O-ring 65 is intervened between the lens 64 and an inner wall of the penetration hole 11A, and thereby the fluid-tight performance is ensured.

The beauty effect applying portion 70 is formed of stainless steel. As shown in FIG. 4 and FIG. 7, the beauty effect applying portion 70 is formed in a substantially conical shape having a spherical portion 70A at a distal end thereof. Further, a shaft portion 70B (as an example of a fixed shaft according to the present invention) is formed at a proximal side of the beauty effect applying portion 70. The shaft portion 70B is inserted into the shaft hole 13A via an insulation collar 71 and an O-ring 72. The beauty effect applying portion 70 is insulated from the handle 10 by the insulation collar 71. The waterproof performance between the beauty effect applying portion 70 and the inner wall of the shaft hole 13A is ensured by the O-ring 72. Further, the shaft portion 70B is locked with the shaft holder 63. As described above, the shaft holder 63 is fastened by the screw S3 when the inner lid 40 is mounted to the handle 10. That is, the beauty effect applying portion 70 is provided with the shaft portion 70B which is inserted into the handle 10 from the end portion 13 toward the housing portion 11 and fixed by the mounting of the handle 10 to the inner lid 40. In particular, as shown in FIG. 4, the small diameter portion 70C formed in a groove shape in the circumference direction is formed at the distal end portion of the shaft portion 70B, and the small diameter portion 70C is locked with the shaft locking portion 63A of the shaft holder 63. With this, the beauty effect applying portion 70 is arranged to be electrically connected to the one electrode of the solar power generation panel 60 via the shaft holder 63, the ring-like terminal 61C and the lead wire 61D and to be fixed to the handle 10 in a state in which the beauty effect applying portion 70 is prevented from being removed from the shaft hole 13A.

The beauty device 1 having such a configuration is used as described below.

Figure 9:
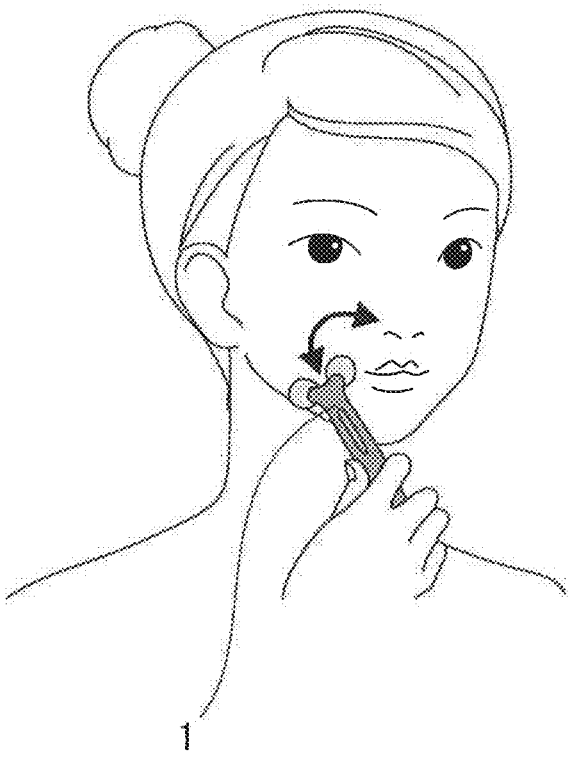
FIG. 9 is a view for explaining a usage example of the beauty device according to the first example in which a beauty effect is applied by a rotation body.

In a case in which the beauty effect is applied to skin by using the rotation body 30, for example, a user holds the handle 10 to press the rotation body 30 against the skin of a face or the like as shown in FIG. 9. Further, the user moves the beauty device 1 in the axial direction of the handle 10 linearly or moves the beauty device 1 in a circular arc. With this, the massage effect such as pressing, pinching, and pulling is applied. At this time, the handle 10 and the rotation body 30 are electrically connected via a body of the user. Thus, when the solar power generation panel 60 receives the light through the lens 64 and generates the electric power, the weak current is supplied between the rotation body 30 and the skin. With this, the massage effect is enhanced.

Figure 10:
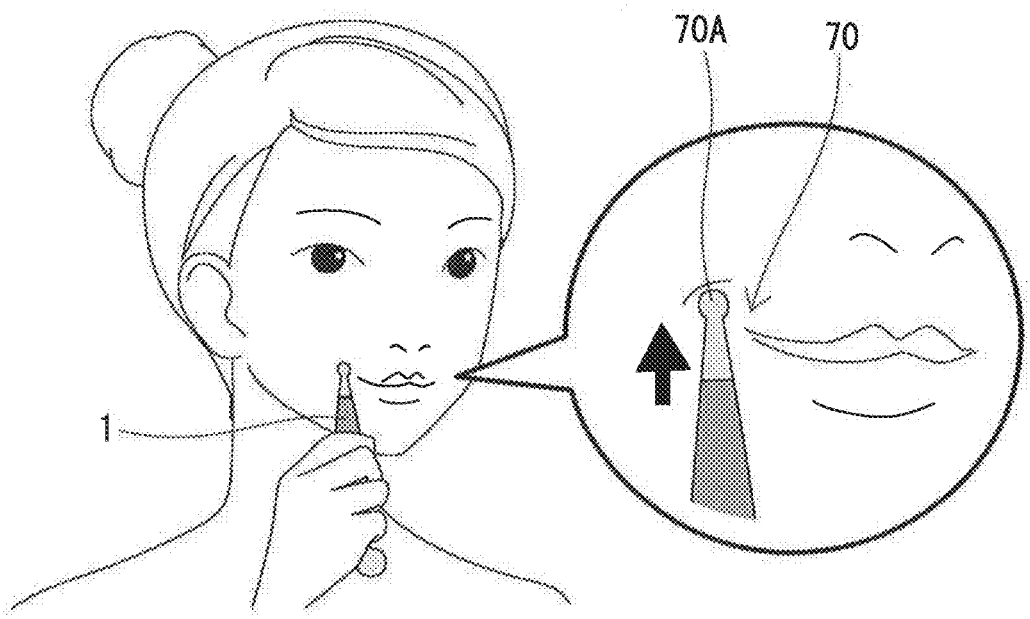
FIG. 10 is a view for explaining a usage example of the beauty device according to the first example in which a beauty effect is applied by a beauty effect applying portion.

In a case in which the beauty effect is applied to skin by using the beauty effect applying portion 70, for example, a user holds the handle 10 to press the spherical portion 70A of the beauty effect applying portion 70 against the skin of a face or the like with an intension in which the user feels good in the manner of therapeutic point pressure as shown in FIG. 10. At this time, the handle 10 and the beauty effect applying portion 70 are electrically connected via a body of the user. Thus, when the solar power generation panel 60 receives the light through the lens 64 and generates the electric power, the weak current is supplied between the beauty effect applying portion 70 and the skin. With this, the massage effect is enhanced.

Next, effects of the beauty device 1 having the configuration described above are described. The beauty device 1 is provided with the inner lid 40 having the water stop portion 41, which contacts with the peripheral edge of the opening of the housing portion 11 in the fluid-tight manner, and mounted to the handle 10 apart from the outer lid 50 which closes the opening of the housing portion 11. Such a configuration can suppress the holding force when the handle 10 is held to be applied to the inner lid 40 directly, and thereby an influence to the water stop performance of the water stop portion 41 can be suppressed.

Accordingly, the beauty device 1 can successfully ensure waterproof performance.

Further, the beauty device 1 is provided with the solar power generation panel 60 serving as a housed member which is assembled to the inner lid 40 and housed in the housing portion 11. In this way, since the solar power generation panel 60 is housed in the housing portion 11, the waterproof performance thereof can be ensured. Further, since the solar power generation panel 60 can be housed in the housing portion 11 by mounting the inner lid 40, the assembling operation can be simplified.

Further, the beauty device 1 is provided with the solar power generation panel 60 as a power source portion which generates current as a housed member, and the rotation body 30 has conductivity, and the support shaft 20 has conductivity to supply the current of the solar power generation panel 60 to the rotation body 30. Thus, the current is preferably supplied to the rotation body 30 from the solar power generation panel 60 in which the waterproof performance is ensured.

Further, the beauty device 1 is provided with the beauty effect applying portion 70, which applies the beauty effect to the skin while contacting with or being close to the skin, arranged on another end portion 13 of the handle 10. Further, the beauty effect applying portion 70 is provided with the shaft portion 70B as a fixed shaft which is inserted into the handle 10 from the end portion 13 toward the housing portion 11 and fixed when the inner lid 40 is mounted to the handle 10. Thus, the beauty effect can applied by using the other end portion 13 in addition to the beauty effect applied by using the rotation body 30 at the side of the one end portion 12 of the handle 10. With this, the beauty device 1 capable of applying the beauty effect in various aspects in addition to the applying of the beauty effect by the rotation body 30 can be obtained.

Further, in the present example, the inner lid 40 is formed such that the water stop portion 41 is contacted with the peripheral edge of the opening of the housing portion 11 while being pressed in the direction in which the inner lid 40 is mounted. That is, the water stop portion 41 is pressed against the peripheral edge of the opening of the housing portion 11 in the pressing direction defined by the mounting direction of the inner lid 40 to the handle 10. With this, water stop by the water stop portion 41 can be achieved firmly, and the waterproof performance can be enhanced.

Further, in the present example, a plurality of the stripes like a ridge is arranged on each outer surface of the handle 10 and the outer lid 50. Thus, this configuration can contribute to the improvement of design. Further, a slipping prevention effect in holding can be obtained due to the stripes like a ridge. Since it is considered that the beauty device 1 is used in an environment such as in using with cosmetics or the like and in bathing in which a hand of a user is slippery, it is preferable that such a slipping prevention portion is arranged on the handle 10. Further, since the handle 10 can be held stably, the outer lid 50 can be similarly held stably, and therefore an unbalanced load is prevented from applying to the inner lid 40. In this way, by forming a plurality of stripes like a ridge on the outer surfaces of the handle 10 and the outer lid 50, an effect of the fluid-tight performance by the water stop portion 41 is further enhanced.

Further, in the present example, the diamond cut is formed on the outer surface of the rotation body 30. Thus, the rotation of the rotation body 30 can be visually recognized easily, and therefore usability is improved. Further, by forming patterns on the outer surface, the rotation body 30 can be suppressed to be slipped without rotating in a slippery state in which the beauty device 1 is used together with the cosmetics or the like.

OTHER EXAMPLES

The present invention is not limited to the example described above with reference to the drawings, and for example, the following examples are encompassed by the scope of the present invention.

(1) In the example described above, a configuration in which the handle is formed of the ABS resin on which the chrome plating is applied is described as an example, however other material may be utilized. Further, the plating is not necessarily applied.

(2) In the example described above, a configuration in which the rotation body is formed of the ABS resin on which the platinum plating is applied is described as an example, however other material may be utilized. Further, the plating is not necessarily applied.

(3) In the example described above, a configuration in which the rotation body is formed in a substantially spherical shape is described as an example, however other shape such as an oval shape in a section, an ellipse shape in a section, a half spherical shape, a gourd shape, and a cylindrical shape may be adopted as the shape of the rotation body.

(4) In the example described above, a configuration in which the solar power generation panel as the housed member is mounted to the inner lid and housed in the housing portion is described as an example, however it is not limited to this. A configuration in which the housed member is individually housed in the housing portion and then the inner lid is mounted may be adopted.

(5) In the example described above, a configuration in which the housed member is the solar power generation panel is described as an example, however such a configuration is not essential. Further, a configuration in which the housed member is electrically connected to at least one of the rotation body and the beauty effect applying portion is not essential.

(6) In the example described above, a configuration in which the housed member is the solar power generation panel as a power source portion is described as an example, however it is not limited to this. A dry battery or the like may be utilized as the power source portion.

(7) In the example described above, a configuration in which the beauty effect applying portion is arranged is described as an example, however such a configuration is not essential. Further, in a case in which the beauty effect applying portion is arranged, it is not limited to the example described above, and for example, a beauty effect applying portion having other configuration such as one or more rotation bodies may be adopted.

(8) In the example described above, a configuration in which the housed member is housed in the housing portion is described as an example, however it is not limited to this. The housing portion may be formed as a space for light weighting or for sink in molding. In this case, it is not essential that the housed member is housed in the housing portion, and the housing portion may be merely formed as a hollow space.

(9) In the example described above, a configuration in which the stripes like a ridge are formed on the outer surface of the handle is described as an example, however various shapes such as recessed stripes formed such that a finger can be hooked in the stripes may be formed on the outer surface of the handle. Further, a configuration in which such stripes are not formed on the outer surface may be adopted.

(10) In the example described above, a configuration in which so-called diamond cut is applied to the outer surface of the rotation body is described as an example, however it is not essential. For example, various patterns such as ring-like patterns around the rotation axis, and vertical stripe patterns along the rotation axis may be adopted as the patterns on the outer surface of the rotation body. Further, a smooth sphere without such patterns may be adopted.

(11) In the example described above, a configuration in which the angle θ1 between the axial centers of the support shafts which form a pair is set to approximately 66.7 degrees and the support shafts are arranged to spread toward the distal ends thereof is described as an example, however it is not limited to this. The angle θ1 between the axial centers of the support shafts which form a pair is not especially limited as long as the support shafts are arranged to spread toward the distal ends, however the angle θ1 may be set in a range of, for example, 60 degrees to 80 degrees.

(12) In the example described above, a configuration in which a pair of the support shafts 20 is inclined toward the rear surface side of the handle with the angle θ2 of substantially 60 degrees against the center line of the handle is described as an example, however the angle θ2 is not especially limited. The inclined angle may be set in a range of, for example, 25 degrees to 90 degrees.

(13) In the example described above, a configuration in which the handle is branched in a spread manner at the side of the end portion as one end side in the longitudinal direction is described as an example, however as such a branch, not only the simply bifurcated branch but also various branch aspects such as a trifurcated branch in which a protrusion protruded toward an extension direction of the handle from a center of the branch branched in a spread manner is arranged, may be adopted.

(14) In the example described above, a configuration in which the water stop portion is integrally formed in the inner lid is described as an example, however it is not limited to this. As the water stop portion, a configuration in which the water stop portion is separately formed from the inner lid such as an O-ring, and a configuration in which the water stop portion is integrally formed with the peripheral edge of the opening of the housing portion of the handle may be adopted.

The invention claimed is:

1. A beauty device comprising:

a handle formed with a housing portion in a recessed shape;

an inner lid mounted to the handle to seal the housing portion;

a pair of support shafts extended from an end portion at one side of the handle;

a pair of rotation bodies rotatably supported around the support shafts;

a water stop portion intervened between the housing portion and the inner lid;

an outer lid which closes an opening of the housing portion while covering the inner lid, wherein the water stop portion contacts with a peripheral edge of the opening of the housing portion in a fluid-tight manner, and the outer lid is fitted in the housing portion in a state where an outer circumference surface of the outer lid is arranged to face an inner circumference surface of the opening of the housing portion and a part where the outer circumference surface and the inner circumference surface face each other is visible from an outside, the inner circumference surface being formed to extend in a depth direction of the housing portion; and a beauty effect applying portion arranged at another end portion of the handle, wherein the beauty effect applying portion comprises a spherical portion that is configured to apply a beauty effect to skin by contacting the skin, and the spherical portion is connected to a fixed shaft, and the fixed shaft is received within the handle from the another end portion of the handle and the inner lid is configured to engage with the pair of support shafts, and the inner lid is configured to place a shaft holder in a position to engage and lock the fixed shaft to the handle.

2. The beauty device according to claim 1, wherein the water stop portion is arranged on an outer edge of the inner lid and contacts with the peripheral edge of the opening of the housing portion while being pressed in a mounting direction of the inner lid to the handle.

3. The beauty device according to claim 2, further comprising a housed member which is assembled to the inner lid and housed in the housing portion.

4. The beauty device according to claim 3, wherein the housed member is a power source portion which generates current, and the handle and each of the rotation bodies have conductivity and are electrically connected to the power source portion.

5. The beauty device according to claim 1, further comprising a housed member which is assembled to the inner lid and housed in the housing portion.

6. The beauty device according to claim 5, wherein the housed member is a power source portion which generates current, and the handle and each of the rotation bodies have conductivity and are electrically connected to the power source portion.

7. A beauty device comprising:

a handle formed with a housing portion in a recessed shape;

an inner lid mounted to the handle to seal the housing portion;

a pair of support shafts extended from an end portion at one side of the handle;

a pair of rotation bodies rotatably supported around the support shafts;

a water stop portion intervened between the housing portion and the inner lid to contact with a peripheral edge of an opening of the housing portion in a fluid-tight manner;

an outer lid which closes an opening of the housing portion while covering the inner lid such that the outer lid is fitted in the housing portion in a state where an outer circumference surface of the outer lid is arranged to face an inner circumference surface of the opening of the housing portion and a part of the outer circumference surface facing the inner circumference surface is visible from an outside; and a beauty effect applying portion arranged at another end portion of the handle, wherein the beauty effect applying portion comprises a spherical portion that is configured to apply a beauty effect to skin by contacting the skin, and the spherical portion is connected to a fixed shaft, and the fixed shaft is received within the handle from the another end portion of the handle and the inner lid is configured to engage with the pair of support shafts, and the inner lid is configured to place a shaft holder in a position to engage and lock the fixed shaft to the handle.

8. The beauty device according to claim 7, wherein the water stop portion is arranged on an outer edge of the inner lid.

9. The beauty device according to claim 7, further comprising a housed member which is assembled to the inner lid and housed in the housing portion.

10. The beauty device according to claim 9, wherein the housed member is a power source portion which generates current, and the handle and each of the rotation bodies have conductivity and are electrically connected to the power source portion.

* * * * *